US005961351A

United States Patent [19]

Wu

[11] Patent Number: 5,961,351

[45] Date of Patent: Oct. 5, 1999

[54] UNIVERSAL SERIAL BUS B-TYPE PLUG CONNECTOR

[75] Inventor: Kun-Tsan Wu, Tu-Chen, Taiwan

[73] Assignee: Hon Hai Precision Ind. Co., Ltd., Taipei Hsien, Taiwan

[21] Appl. No.: 08/903,115

[22] Filed: Jul. 30, 1997

[30] Foreign Application Priority Data

Aug. 21, 1996 [CN] China ..... 85212912
Aug. 21, 1996 [CN] China ..... 85212913

[51] Int. Cl.[6] ..... H01R 9/03

[52] U.S. Cl. ..... 439/610; 439/752.5

[58] Field of Search ..... 439/610, 607

[56] References Cited

U.S. PATENT DOCUMENTS

| | | | |
|---|---|---|---|
| 4,456,317 | 6/1984 | McCleery | 439/607 |
| 4,678,121 | 7/1987 | Douty et al. | 439/610 |
| 5,035,652 | 7/1991 | Shibano | 439/610 |
| 5,092,794 | 3/1992 | Kachlic | 439/610 |
| 5,199,903 | 4/1993 | Asick et al. | 439/610 |

*Primary Examiner*—Neil Abrams
*Assistant Examiner*—J. F. Duverne

[57] ABSTRACT

A Universal Serial B-type plug connector (1) consists of a dielectric casing (10) defining a front recess (22) for receiving a mating receptacle connector, four rear trenches (16) defined by a horizontal partition (13) and a vertical partition (14) mutually perpendicular to each other and four mounting channels (17) connecting the trenches (16) with the recess (22), respectively. Four contact pieces (30) each have a contact (32) extending into the recess (22), a mounting section (37) forcedly fitted into the one of the mounting channels (17), and a terminal portion (31) snugly fit into one of the trenches (16). A rear shield frame portion (50) has a base plate (51) abutting a rear end (13) of the dielectric casing (10) and two wings (502, 504) clipping a cable (2) connected with the connector (1). A front shield frame portion (70) has locking hooks (72) at a rear end thereof which are securely fixed to mounting slots (54) of the base plate (51), whereby the front shield frame portion (70) cooperates with the rear shield frame portion (50) to electromagnetically shield the dielectric housing (10).

18 Claims, 10 Drawing Sheets

UNIVERSAL SERIAL BUS B-TYPE PLUG CONNECTOR

BACKGROUND OF THE INVENTION

1. Field of The Invention

The invention relates to an electric connector, particularly to a Universal Serial Bus (USB) B-type plug connector, and more particularly to an improved USB B-type plug connector concerning the casing shield frame and contact pieces thereof.

The USB connector is a recently developed connector which can be used to replace most of the input/out (I/O) connectors, for example, D-Sub connectors and Mini-Dins as can be seen in the back of a computer.

2. The Prior Art

With the advancement of communication and computer technology, electrical connectors are being constantly improved to meet more and more strict requirements.

FIG. 1 shows a prior art input/output connector in accordance with U.S. Pat. No. 4,516,822 ('822 patent) that has poor electrical connecting characteristic between the cable and contact pieces of the connector.

FIGS. 2 and 3 show another two prior art connectors in accordance with U.S. Pat. Nos. 5,073,130 and 5,267,882, respectively. Although these two prior art connectors can overcome the problem of the '822 patent, they both have a complicated structure, which causes difficulty in connector manufacturing and assembly. Moreover, it is not very convenient to connect the contact pieces of these two connectors with cables.

Additionally, Taiwan Patent Application Nos. 83310726, 81300211 and 81217896, and U.S. Pat. Nos. 5,013,262, 5,017,156 and 5,221,212 disclose some other connectors which also have the above mentioned disadvantages.

Therefore, an objective of the invention is to provide an electrical connector, particularly a USB B-type plug connector, which has a simple structure so that it can be easily manufactured and has a lower cost.

Another objective of the invention is to provide an electrical connector, particularly a USB B-type plug connector, with a casing shield frame which can be easily manufactured and assembled.

A further objective of the invention is to provide an electrical connector, particularly a USB B-type plug connector, with contact pieces which can easily connect with a cable and has good electrical and mechanical connecting characteristics therewith.

Still a further objective of the present invention is to provide an electrical connector, particularly a USB B-type plug connector, with contact pieces which can be easily mounted in a connector's dielectric casing.

SUMMARY OF THE INVENTION

According to an aspect of the invention, an electric connector, particularly a USB B-type plug connector, includes a dielectric casing defining a front recess for receiving a mating receptacle connector, four rear trenches and four mounting tunnels connecting the trenches with the recess. Four contact pieces each have a contact extending into the recess, a terminal portion snugly set in one of the trenches and a mounting section located between the contact and terminal portion which is forcedly fitted in one of the mounting tunnels. A cable has four leads each being electrically and mechanically connected to one of the terminal portions by crimping them into the terminal portions. Furthermore, a soldering operation can be optionally applied to the terminal portions to enhance the mechanical and electrical connection between the contact pieces and the cable. A casing shield frame consists of a rear and front shield frame portion. The rear shield frame portion has a base plate abutting a rear end of the dielectric casing and two wings connected with each other and clipping the cable. The front shield frame portion has a rear end fixed to the base plate. The front and rear shield frame portions cooperate to electromagentically shield the contact pieces and the leads of the cable connected with the contact pieces. A cap and a cable strain relief sleeve are integrally formed on the rear part of the front shield frame portion, the whole rear shield frame portion and a part of the cable near the rear shield frame portion.

BRIEF DESCRIPTION OF THE DRAWINGS

FIG. 6(A) is a cross-sectional view showing a secure mounting of a contact piece mounting section in a mounting tunnel defined generally at a middle part of a dielectric casing of the connector in accordance with the present invention;

DETAILED DESCRIPTION OF THE PREFERRED EMBODIMENT

References will now be described in detail to the preferred embodiment of the invention. While the present invention has been described in reference to the specific embodiment, the description is illustrative of the invention and is not to be construed as limiting the invention. Various modifications to the present invention can be made to the preferred embodiment by those skilled in the art without departing from the true spirit and scope of the invention as defined by appended claims.

Figure 1:
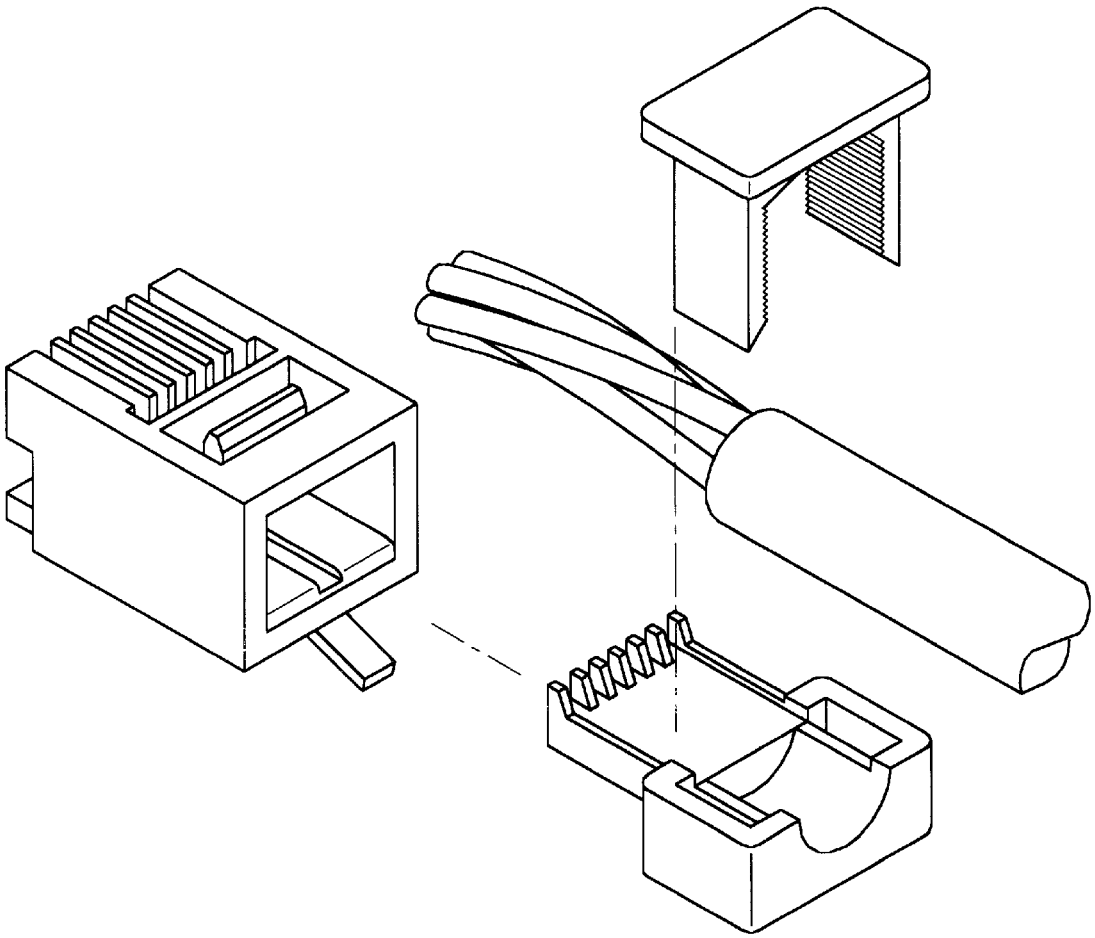
FIG.1 (PRIOR ART)
FIG. 1 is a perspective view showing an electric connector in accordance with U.S. Pat. No. 4,516,822.
Figure 2:
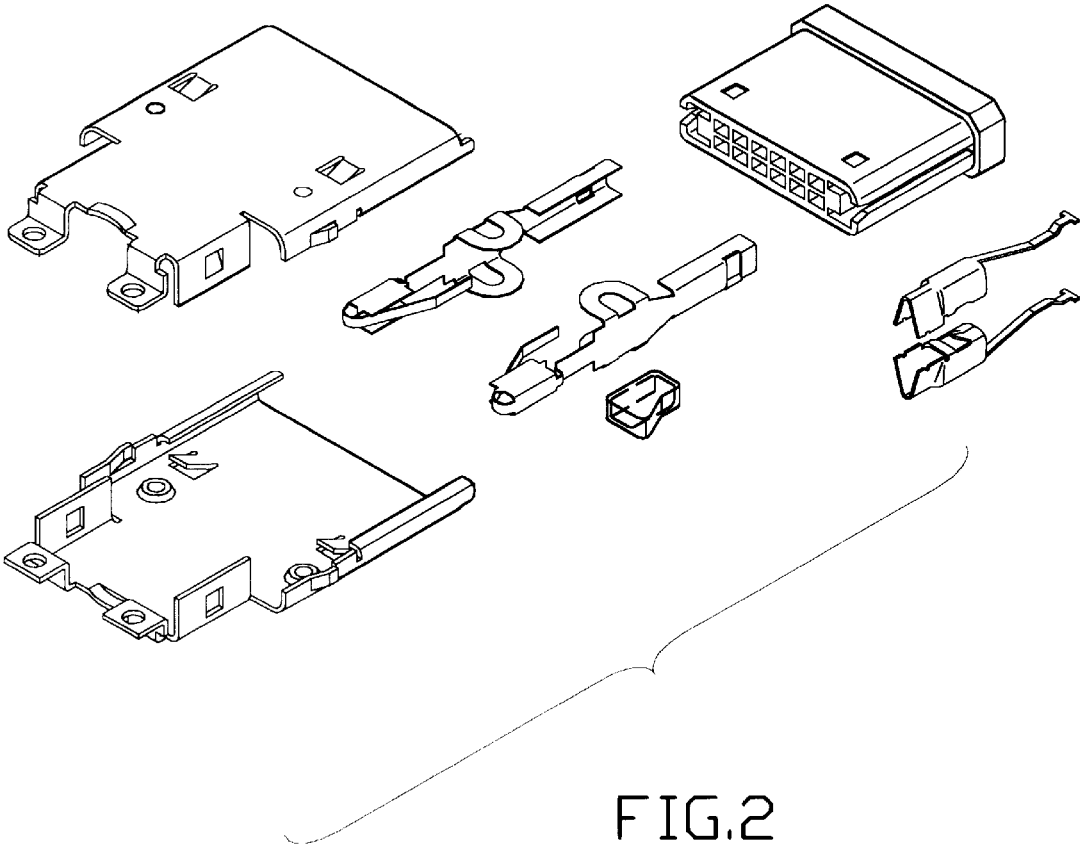
FIG.2 (PRIOR ART)
FIG. 2 is a perspective, exploded view showing an electric connector in accordance with U.S. Pat. No. 5,073,130.
Figure 3:
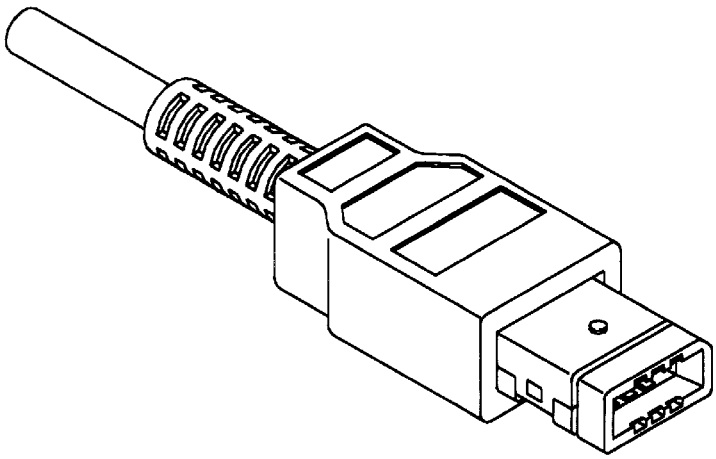
FIG.3 (PRIOR ART)
FIG. 3 is a perspective view showing an electric connector in accordance with U.S. Pat. No. 5,267,882.
Figure 4:
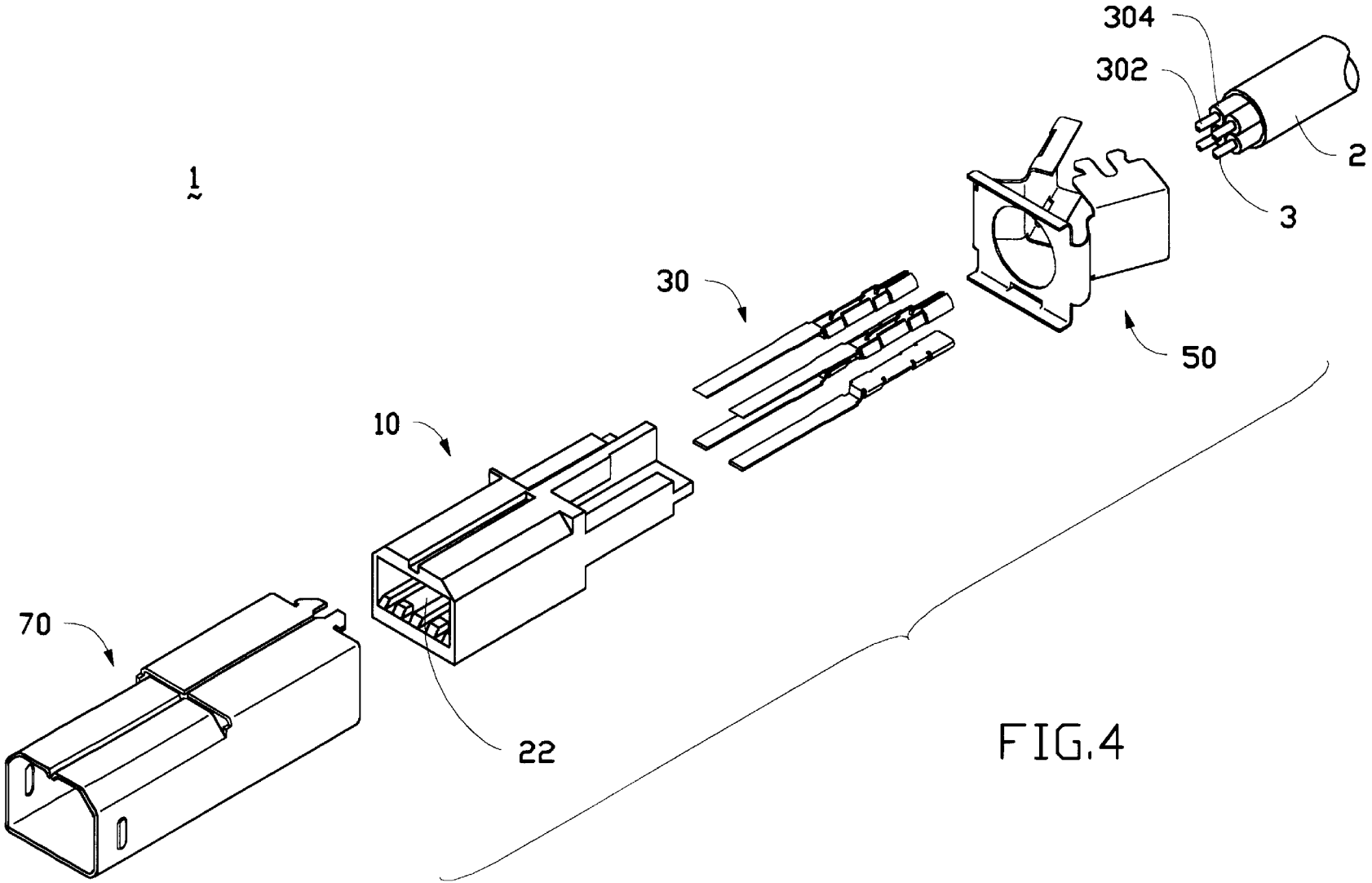
FIG. 4 is a front-top-right perspective, exploded view showing the elements for constituting a USB B-type plug connector in accordance with the present invention.

Referring to FIG. 4, a USB B-type plug connector in accordance with the present invention is generally indicated by referenced number 1. The connector 1 consists of a dielectric casing 10 defining a front recess 22 for connecting with a mating receptacle connector (not shown). A front shield frame portion 70 is used to connect with a rear shield frame portion 50 to form a casing shield frame for surrounding the dielectric casing 10 to electromagnetically shield four contact pieces 30 which are going to be mounted in the dielectric casing 10, and four leads 3 of a cable 2 which are going to be mechanically and electrically connected with the contact pieces 30. The rear shield frame portion 50 is also used to electromagnetically shield an end part of the cable 2 near the four contact pieces 30.

Figure 5:
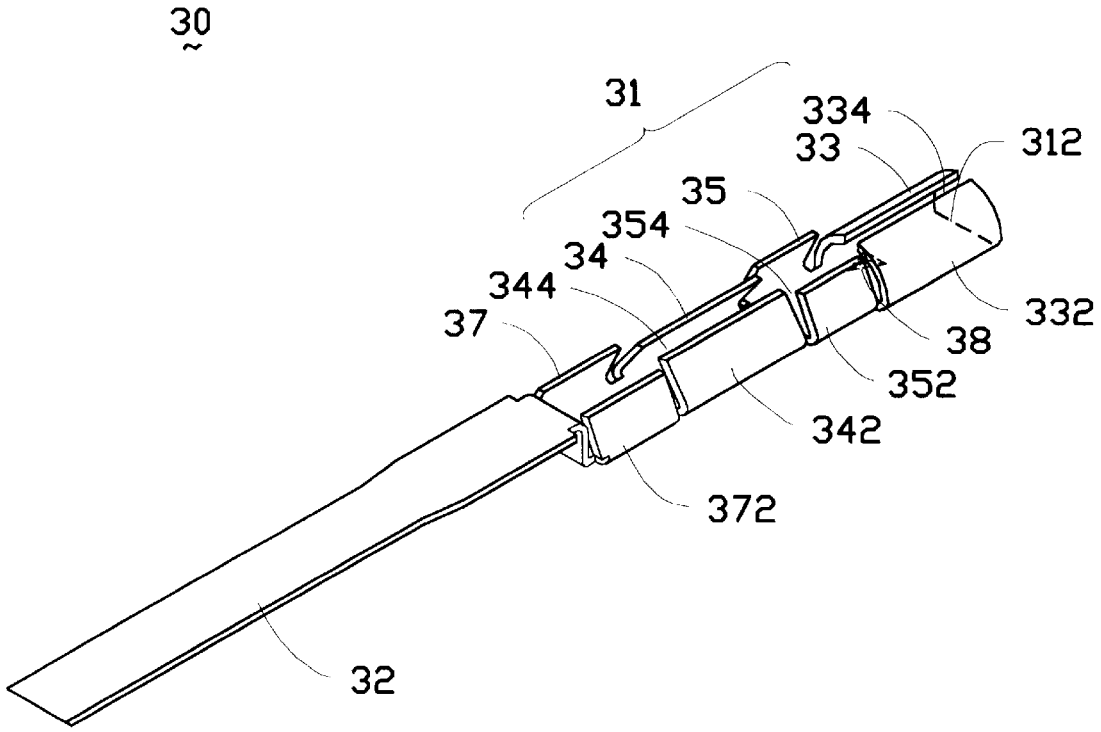
FIG. 5 is a front-top-right perspective view showing a contact piece of the USB B-type plug connector in accordance with the present invention.
Figure 6:
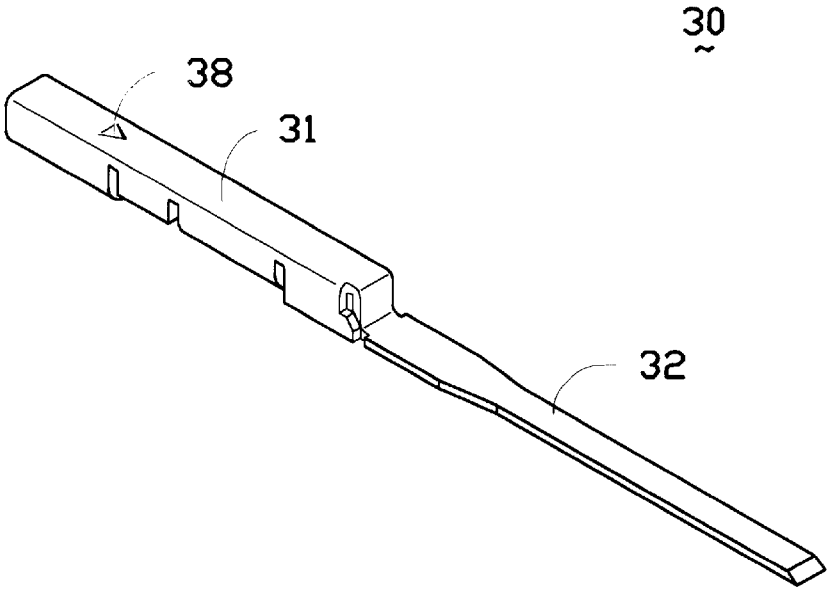
FIG. 6 is a perspective view of the contact piece of FIG. 5 as viewed from another direction.
Figure 6:
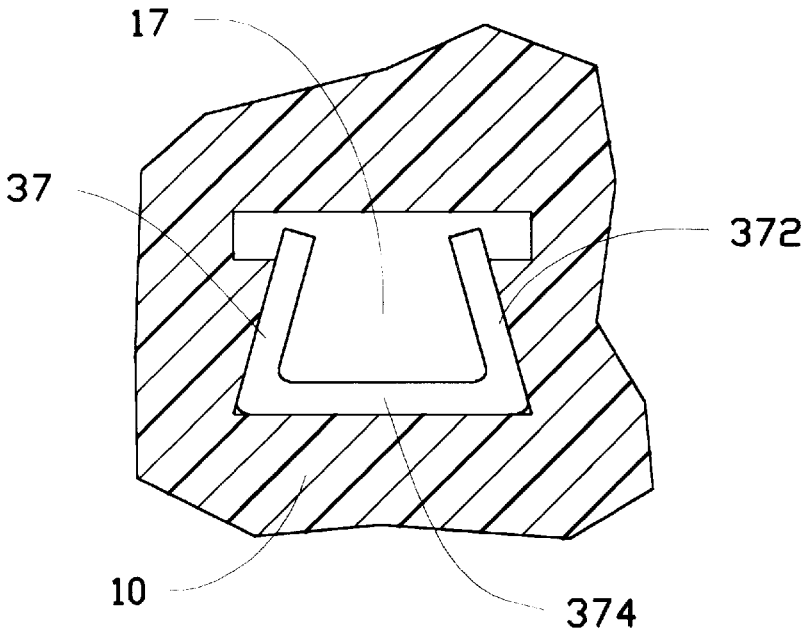

Referring to FIGS. 5 and 6, each of the contact pieces 30 is formed to have a contact 32 in the shape of an elongated tab and a terminal portion 31 consisting of a first crimping section 33, a second crimping section 34, and a soldering section 35 between the two crimping sections 33, 34. A mounting section 37 is located at a front of the second crimping section 34. The first and second crimping sections 33, 34 and the soldering section 35 are used for electrically and mechanically connecting with a corresponding lead 3 of the cable 2. The mounting section 37 is used to facilitate the mounting of the contact piece 30 in the dielectric casing 10. More detailed descriptions will be made below concerning this point.

The first and second crimping sections 33, 34 and the soldering section 35 are formed to have a pair of side walls 332, 342 and 352, respectively, which are connected to a common bottom wall 312. The side walls 332, 342 and 352 define gaps 334, 344 and 354 therebetween, respectively, wherein the gap 354 has the largest dimension in width, while the gap 334 has the middle dimension and the gap 344 has the smallest dimension. A pointed projection 38 is formed on the common bottom wall 312 and located at a front end of the first crimping section 33.

When the terminal portion 31 is used to connect with a corresponding lead 3, as shown in FIG. 4, a front end portion of the lead 3, which consists of an insulated part 304 and an uninsulated part 302 and has a length substantially the same as that of the terminal portion 31, is extended into the terminal portion 31. The uninsulated part 302 has a length the same as that of the second crimping section 34 with the soldering section 35. The front end portion of the lead 3 is extended into the terminal portion 31 to reach a position in which the uninsulated part 302 is extended over the second crimping and soldering sections 34 and 35, and the insulated part 304 is extended over the first crimping section 33. Thereafter, the side walls 332, 342 of the first and second crimping sections 33, 34 are crimped to tightly engage with the uninsulated part 302 and the insulated part 304 of the lead 3 to electrically and mechanically connect the lead 3 with the contact piece 30. However, if such a connection cannot sustain a predetermined requirement after a test is conducted, solder can be optionally applied to the soldiering section 35 of the contact piece 30 by filling the gap 354 with solder. By this way, the electrical and mechanical connecting effectiveness between the lead 3 and the contact piece 30 can be enhanced. When the first crimping section 33 is crimped, the pointed projection 38 will insert into the insulated part 304 of the lead 3, thereby increasing the mechanical holding ability of the contact piece 30 over the lead 3.

Now referring to FIG. 6(A), the mounting section 37 consists of two side walls 372 connected with a flat bottom wall 374, wherein the two side walls 372 are bent toward the bottom wall 374 to form a dovetail-like structure. The dielectric casing 10 is formed to have a mounting tunnel 17 which has a configuration meeting that of the mounting section 37. When the mounting section 37 is inserted into the mounting tunnel 17 as shown by FIG. 6(A), the mounting section 37 will have a force fit with the dielectric casing 10 defining the mounting tunnel 17, whereby the mounting section 37 is fixed into the mounting tunnel 17, and, therefore, the contact piece 30 is securely mounted in the dielectric casing 10.

Figure 7:
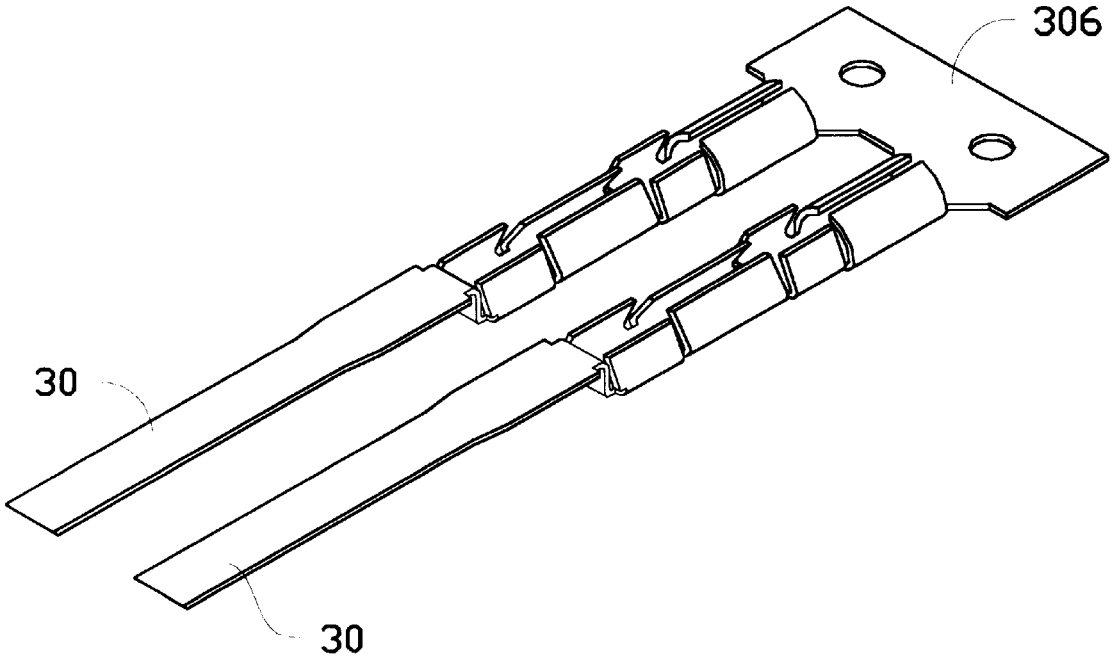
FIG. 7 is a perspective view showing two contact pieces formed to connect with a common base blank which will be removed from the contact pieces after they are mounted in the dielectric casing.

Referring to FIG. 7, two contact pieces 30 are formed to connect with a common base blank 306 which will be removed from the contact pieces 30 after they are mounted in the dielectric casing 10. Such a design will enable two contact pieces 30 to be simultaneously mounted in the dielectric casing 10 thereby saving time for mounting the contact pieces 30.

Figure 8:
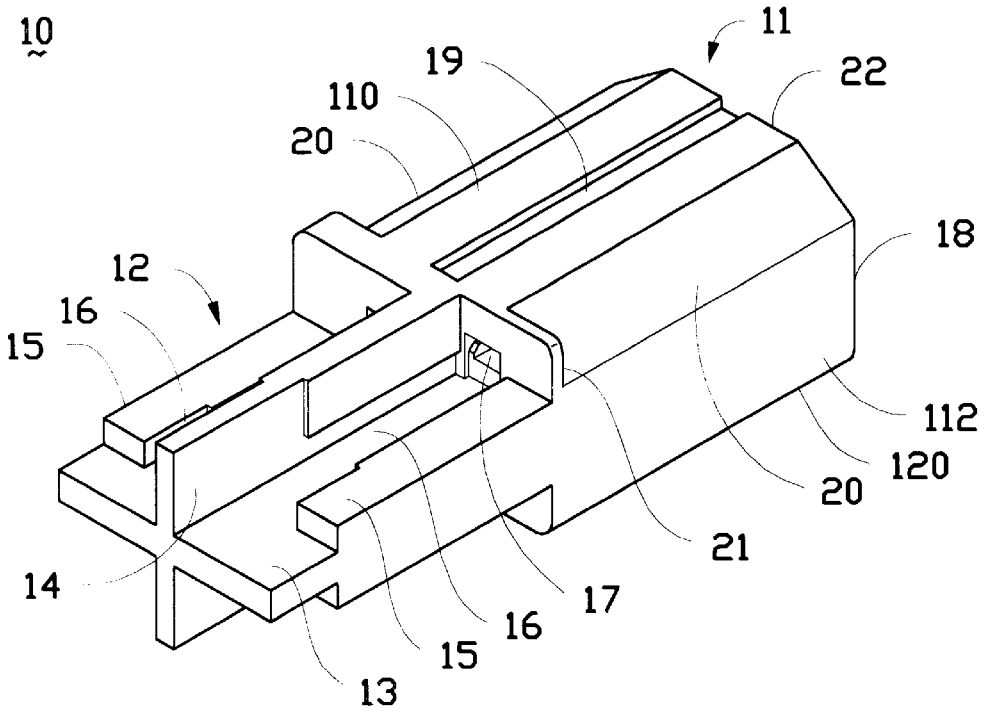
FIG. 8 is a perspective view showing the dielectric casing.

FIG. 8 shows the dielectric casing 10, which can be generally divided into a front casing portion 11 and a rear casing portion 12 by a stopping wall 21. The front casing portion 11 is configured as a hollow rectangular block defining a front end 18, a top wall 110, a bottom wall 120, two side walls 112, a pair of chamfered walls 20 between the top wall 110 and the two side walls 112, and a groove 19 on the top wall 110 between the two chamfered walls 20. The groove 19 extends from the front end 18 toward the stopping wall 21. The rear casing portion 12 consists mainly of a horizontal partition 13 and a vertical partition 14 in a cross-like arrangement. Four elongated locating blocks 15 are formed on side edges of the horizontal partition 13 and cooperate with the horizontal and vertical partitions 13, 14 to form four terminal portion accommodating trenches 16. There are four mounting tunnels 17 formed in the dielectric casing 10. Each mounting tunnel 17 has a, configuration as shown in FIG. 6(A) and is located between the recess 22 and a corresponding trench 16.

Figure 9:
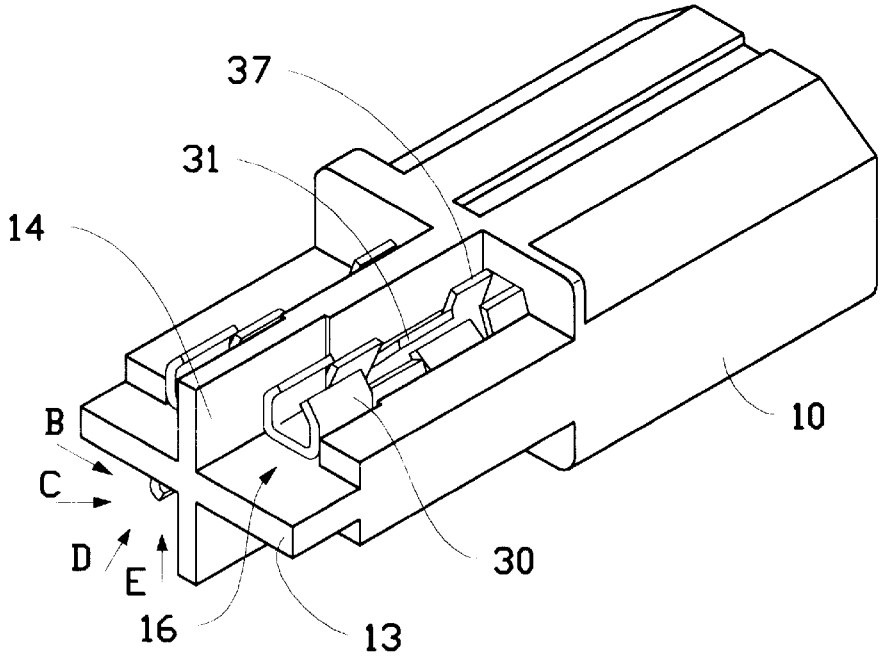
FIG. 9 is a view similar to FIG. 8 but shows that four contact pieces are mounted in the dielectric casing.

To mount the contact pieces 30 in the dielectric casing 10, first, two contact pieces 30 as shown in FIG. 7 are brought to simultaneously extend into the upper two accommodating trenches 16 to reach a position in which the contacts 32 are received in the recess 22. The front parts of the mounting sections 37 are forcedly fitted in the mounting tunnels 17, and the terminal portions 31 are snugly received in the trenches 16, whereby the two contact pieces 30 are securely mounted in the dielectric casing 10. Thereafter, the common base blank 306 is bent away from the contact pieces 30. Then, another two contact pieces 30 connected to another common base blank 306 are brought to be securely mounted in the dielectric casing 10 by extending the other two contact pieces 30 into the lower two accommodating trenches 16 and repeating the above operation concerning the previous two contact pieces. Accordingly, four contact pieces 30 can be securely mounted in the dielectric casing 10 as shown in FIG. 9. Since in the present invention only a two-step operation is needed to extend the contact pieces into the accommodating trenches 16 and bend the blanks 306 away from the contact pieces 30 when mounting the four contact pieces 30 in the dielectric casing 10 and does not need any special tools, the time needed to mount the contact pieces 30 in the dielectric casing 10 is relatively short and the operation is relatively simple.

Thereafter, the leads 3 of the cable 2 are brought to extend into the terminal portions 31 and connected therewith by crimping the first and second crimping sections 33, 34. Optionally, as mentioned above, solder can be applied to the soldering sections 35, if necessary, to enhance the connecting effectiveness between the cable 2 and the contact pieces 30. As shown in FIG. 9, taking an example of the lower, left contact piece 30, when the terminal portion 31 is received in the accommodating trench 16, the side walls 332, 342, 352 of the crimping and soldering sections 33, 34, 35 are extended into an open space above the trench 16. A crimping or soldering tool can be easily moved from any one of the directions as indicated by arrows B, C, D and E to approach the crimping and soldering sections 33, 34, 35 to perform the necessary operations to connect the lead 3 with the terminal portion 31. Thus, the ease and convenience of crimping and soldering to electrically and mechanically connect the cable 2 with the contact pieces 30 can be greatly improved by the present invention. The directions B to E are ranged within 90 degrees.

After the contacts pieces 30, the dielectric casing 10 and the cable 2 are connected, the rear shield frame portion 50 is brought to be connected therewith. The rear shield frame portion 50 is made of a metal sheet.

Figure 10:
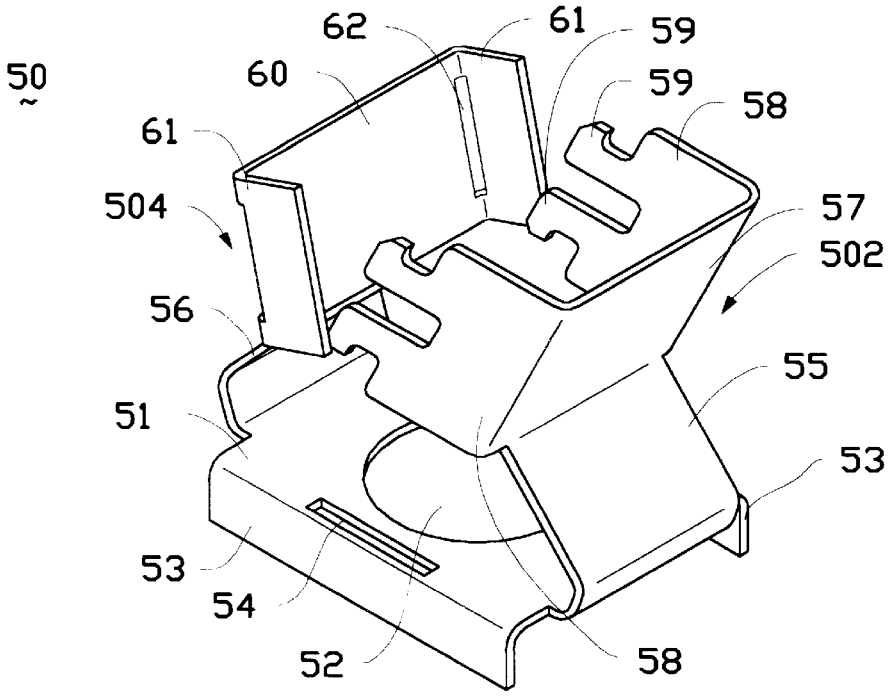
FIG. 10 is a perspective view showing a rear shield frame portion.

As seen from FIG. 10, the rear shield frame portion 50 consists of a base plate 51 defining a central hole 52 having a diameter slightly larger than that of the cable 2 and two mounting slots 54 (only one being shown, beside the central hole 52. Two front extensions 53 are formed on two side edges of the base plate 51 near the mounting slots 54. A first and second wings 502, 504 are extended rearwards from two other side edges of the base plate 51, wherein the first wing 502 is composed of a first lower and upper plates 55 and 57, and the second wing 504 is composed of a second lower and upper plates 56 and 60. The lower plates 55, 56 extend from the base plate 51 toward the central hole 52, and the upper plates 57, 60 extend from the lower plates 55, 56 toward the two other side edges of the base plate 51, respectively. Two connecting arms 58 are extended toward the second wing 504 from two side edges of the first upper plate 57, respectively. Each connecting arm 58 defines a pair of locking hooks 59 at its end distant from the first upper plate 57. Two connecting plates 61 are extended toward the first wing 502 from two side edges of the second upper plate 60, and define two connecting slots 62 with the second upper plate 60. The connecting slots 62 are in alignment with the connecting arms 58.

Figure 11:
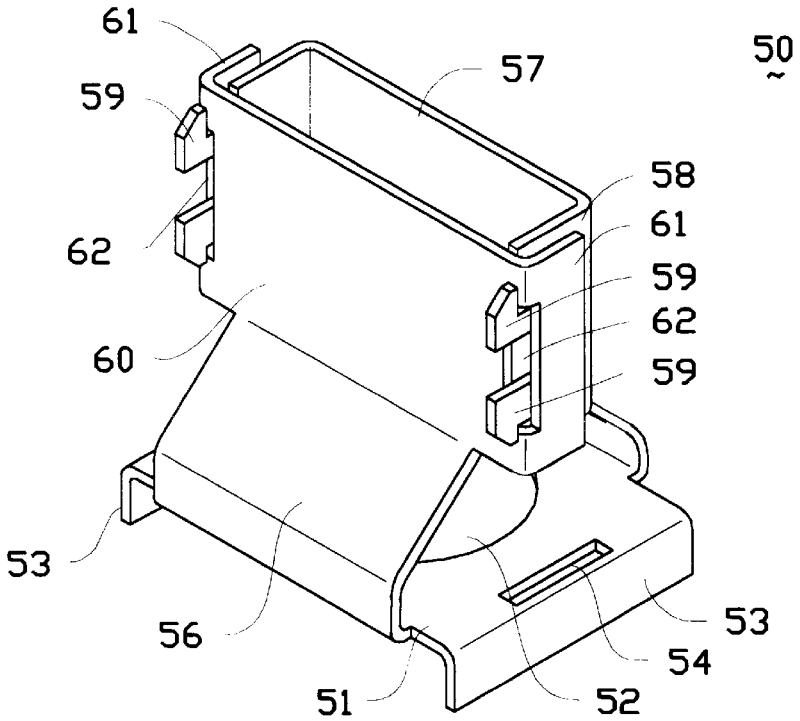
FIG. 11 is a view similar to FIG. 10 but shows that two wings of the rear shield frame portion are moved to connect with each other.

To assemble the rear shield frame portion 50 with the subassembly composed of the dielectric casing 10, the contact pieces 30 and the cable 2, (also referring to FIG. 4) the rear shield frame portion 50 is brought to move through the cable 2 by extending a rear end of the cable 2 through the central hole 52 until a front face of the base plate 51 abuts the rear end of dielectric casing 10, which has a cross-like configuration. Then, the two wings 502, 504 are brought to move toward each other to reach a position as shown by FIG. 11, in which the locking hooks 59 are extended through the connecting slots 62 to engage with the second upper plate 60, whereby the upper plates 57 and 60 work cooperatively to clip the cable 2 so that the rear shield frame portion 50 is connected with the cable 2 and fixed in position.

Figure 12:
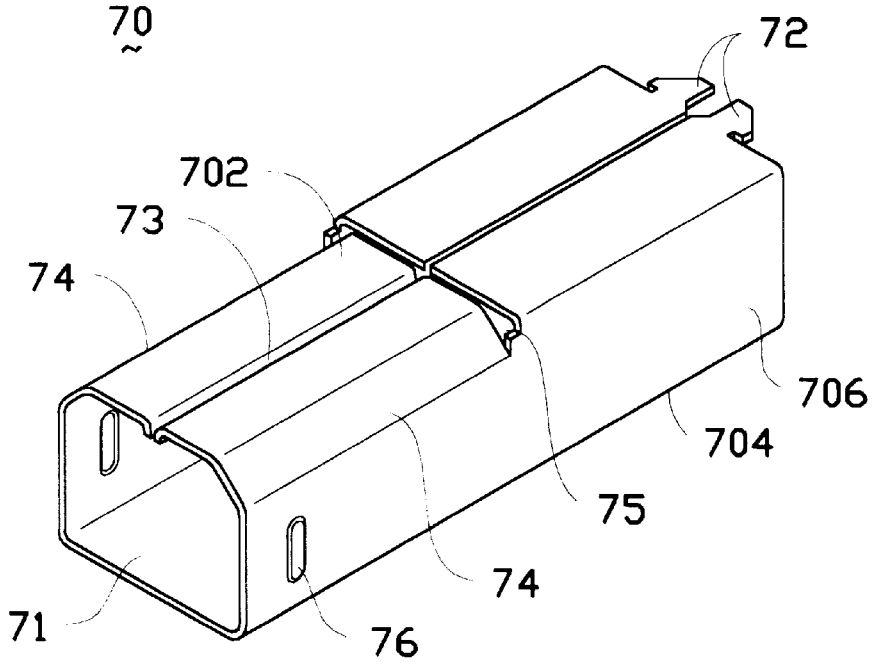
FIG. 12 is a front-right-top perspective view showing a front shield frame portion of the USB B-type plug connector in accordance with the present invention.
Figure 13:
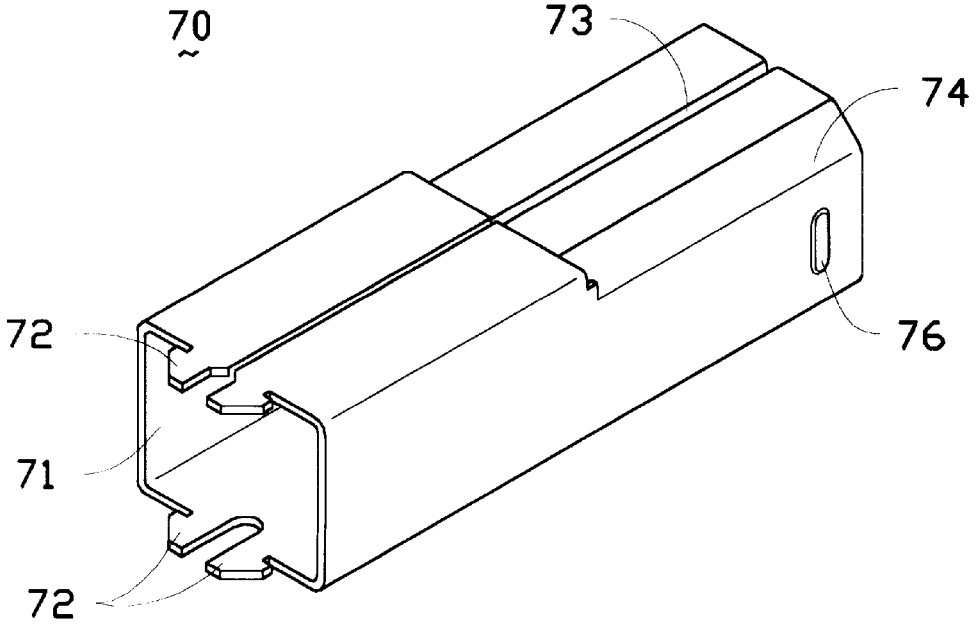
FIG. 13 is a perspective view of the front shield frame portion of FIG. 12 as viewed from another direction.
Figure 14:
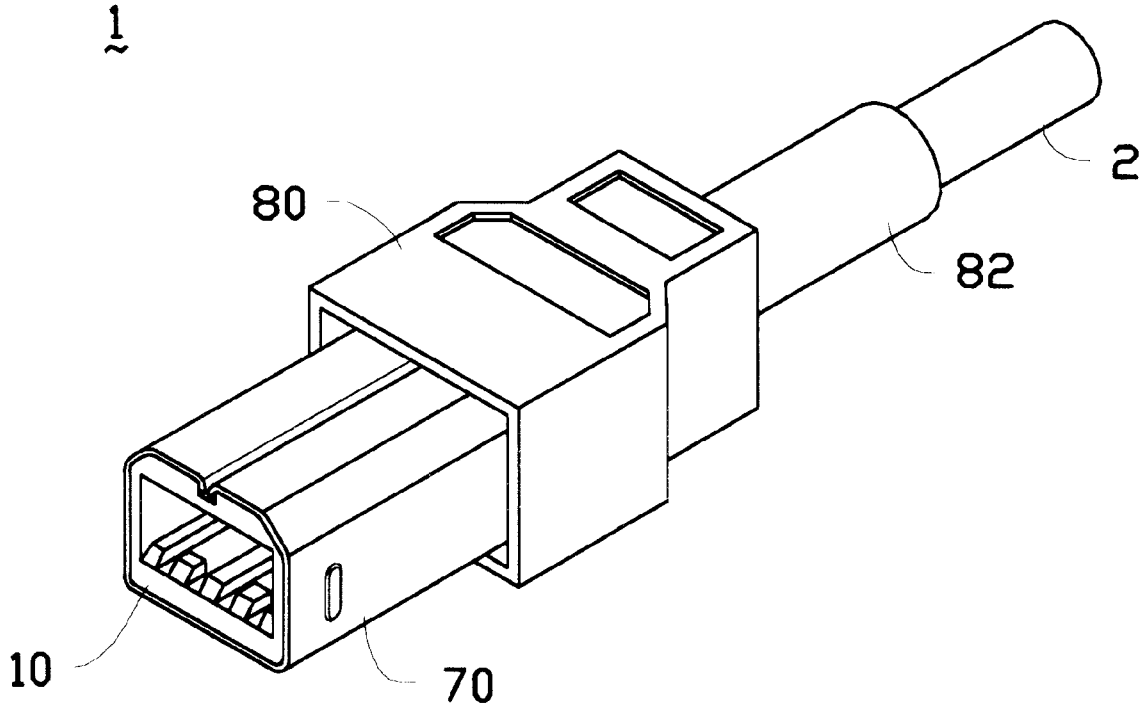
FIG. 14 is a front-right-top perspective view showing that the elements in FIG. 4 which constitute the connector in accordance with the present invention are assembled and then covered with a dielectric cap and cable strain relief sleeve.

Thereafter, the front shield frame portion 70 is brought to connect with the dielectric casing 10 and the rear shield frame portion 50. The front shield frame portion 70 has a length substantially the same as that of the dielectric casing 10. Like the rear shield frame portion 50, the front shield frame portion 70 is also made of a metal sheet. As shown in FIGS. 12 and 13, the front shield frame portion 70 is formed to have a configuration like a hollow, rectangular block defining a top and bottom walls 702, 704, two lateral sides 706 and a hollow space 71 extending therethrough. Two pairs of locking hooks 72 are formed at rear ends of the top and bottom walls 702, 704. Two protrusions 76 are formed about a front end of the two lateral sides 706. The protrusions 76 are used to engage with a corresponding structure in a mating receptacle connector (not shown) when the receptacle connector is connected with the plug connector in accordance with the present invention.

An abutment 75 is formed in a middle of the top wall 702. Two chamfered walls 74 are defined between the lateral sides 706 and the top wall 702, and extend from the front end of the front shield frame portion 70 to terminate at the abutment 75. A downward extending engaging member 73 is longitudinally formed on a center of the top wall 702 from the front end of the front shield frame portion 70 to the abutment 75. The chamfered walls 74 have a configuration meeting that of the chamfered walls 20 formed on the dielectric casing 10.

To assemble the front shield frame portion 70 with the dielectric casing 10 and the rear shield frame portion 50 (also referring to FIG. 4), the front shield frame portion 70 is brought to extend over the dielectric casing 10 by inserting the front end 18 of the dielectric casing 10 through the hollow space 71 from the rear end of the dielectric casing 10 to reach a position in which the locking hooks 72 are extended through the mounting slots 54 to engage with the base plate 51 of the rear shield frame portion 50. The rear end of the front shield frame portion 70 is in contact with the front face of the base plate 51. Rear end parts of top and bottom faces of the top and bottom walls 702, 704 are in contact with the front extensions 53. The abutment 75 abuts with and is blocked by the stopping wall 21. The chamfered walls 74 matingly overlaps the chamfered walls 20. The engaging member 43 is extended into the groove 19 to engage with the top wall 110 defining the groove 19. And the front end of the front shield frame portion 70 is flush with the front end 18 of the dielectric casing 10. Thus, the dielectric casing 10, except the front end 18 defining the recess 22 for receiving a mating receptacle connector, is entirely enclosed by the front and rear shield frame portions 70 and 50, which consist of a casing shield frame for electromagnetically shielding the USB B-type plug connector in accordance with the present invention.

After the above members for constituting the USB B-type plug connector in accordance with the present invention are assembled, they will be subjected to a plastics injection molding process to integrally form a cap 80 and a cable strain relief sleeve 82 thereon. The cap 80 and the sleeve 82 will cover a rear part of the front shield frame portion 70, the whole rear shield frame portion 50 and a front part of the cable 2 near the rear shield frame portion 50 to provide protection to the connection of the cable 2 with the contact pieces 30, and to make handling the connector easier.

While the present invention has been described with reference to specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

Therefore, person of ordinary skill in this field shall understand that all such equivalent structures are to be included within the scope of the following claims.

I claim:

1. A Universal Serial Bus B-type plug connector, comprising:

a dielectric casing having a front end defining a recess for receiving a mating receptacle connector, a rear end, four trenches extending from the rear end toward the front end and four mounting tunnels each connecting one of the trenches with the recess;

four contact pieces each having a contact extending into the recess, a terminal portion snugly set in one of the trenches and a mounting section located between the contact and terminal portion and force fitted in one of the mounting tunnels;

a cable having four leads electrically and mechanically connected with the terminal portions of the contact pieces, respectively;

a rear shield frame portion having a base plate abutting the rear end of the dielectric casing and defining a hole through which the cable is extended, and means extended rearwardly from the base plate for clipping the cable to securely connect the rear shield frame portion with the cable; and a front shield frame portion having a rear end fixedly connected to the base plate and cooperating with the rear shield frame portion to electromagnetically shield the dielectric casing.

2. The Universal Serial Bus B-type plug connector as described in claim 1, wherein the mounting section has two lateral sides connected with a flat bottom wall, the two lateral sides being bent toward the flat bottom wall to form a dovetail-like structure with the bottom wall.

3. The Universal Serial Bus B-type plug connector as described in claim 1, wherein the base plate comprises two opposite side edges and the means for connecting the rear shield frame portion to the cable has a first and second wings extending from the two opposite side edges of the base plate, the first wing having at least one locking hook, the second wing have at least one locking slot, the first and second wings being connected with each other to clip the cable by the locking hook extending through the locking slot and engaging with the second wing.

4. The Universal Serial Bus B-type plug connector as described in claim 3, wherein the first wing has a first upper and lower plates and the second wing has a second upper and lower plates, the first and second lower plates extending from the opposite side edges of the base plate toward the hole defined in the base plate, the first upper plate having at least one locking arm extending toward the second upper plate and having an end distant from the first upper plate and defining the locking hook, the second upper plate having at least one locking plate extending toward the first upper plate and cooperating with the second upper plate to define the locking slot therebetween.

5. The Universal Serial Bus B-type plug connector as described in claim 1, wherein the base plate defines at least one mounting slot beside the hole in the base plate, the rear end of the front shield frame portion having at least one locking hook, the rear end of the front shield frame portion being connected to the base plate by the locking hook extending through the mounting slot and engaging with the base plate.

6. The Universal Serial Bus B-type plug connector as described in claim 1, wherein the front shield frame portion has a top and bottom walls and two lateral sides and the base plate further has at least one extension extending from a side edge of the base plate toward the front shield frame portion, the extension being in contact with one of the top and bottom walls and lateral sides of the front shield frame portion.

7. The Universal Serial Bus B-type plug connector as described in claim 1 further comprising a cap integral with a cable strain relief sleeve, wherein the cap covers a rear part of the front shield frame portion and the whole rear shield frame portion and the cable strain relief sleeve covers a part of the cable near the rear shield frame portion.

8. The Universal Serial Bus B-type plug connector as described in claim 1, wherein the dielectric casing has a top and bottom walls and two lateral sides between the front and rear ends, a stopping wall formed at the top wall about a middle part thereof, the stopping wall dividing the dielectric casing into a front and rear portions, the top wall of the front portion of the dielectric casing defining two first chamfered walls with the two lateral sides, and a groove extending from the stopping wall to the front end of the dielectric casing and located between the two first chamfered walls.

9. The Universal Serial Bus B-type plug connector as described in claim 8, wherein the front shield frame portion further comprises a front end, a second top and bottom walls and two second lateral sides between the front and rear ends of the front shield frame portion, the second top wall defining an abutment about a middle part thereof, two second chamfered walls with the two second lateral sides and an engaging member formed between the abutment and the front end of the front shield frame portion, the second chamfered walls matingly overlapping the first chamfered walls, the abutment abutting the stopping wall and the engaging member extending into the engaging groove and engaging with the top wall defining the engaging groove.

10. The Universal Serial Bus B-type plug connector as described in claim 8, wherein the rear portion having a vertical partition and a horizontal partition forming a cross-like configuration therewith as viewed from the rear end of the dielectric casing, four locating blocks being provided at side edges of the horizontal partition, respectively, the locating blocks cooperating with the vertical and horizontal partitions to form the four trenches in which the terminal portions of the four contact pieces fit snugly.

11. The Universal Serial Bus B-type plug connector as described in claim 1, wherein each of the contacts is configured as an elongated tab.

12. The Universal Serial Bus B-type plug connector as described in claim 1, wherein each of the leads has an uninsulated and insulated part and each of the terminal portions has a first crimping section crimped to the insulated part, a soldering section, and a second crimping section crimped to the uninsulated part.

13. The Universal Serial Bus B-type plug connector as described in claim 12, wherein the soldering section is applied with solder to connect with the uninsulated part.

14. The Universal Serial Bus B-type plug connector as described in claim 12, wherein the first crimping section is located at an end of the terminal portion distant from the contact, the soldering section is located near the first crimping section and the second crimping section is located near the soldering section.

15. The Universal Serial Bus B-type plug connector as described in claim 12, wherein the first crimping section further has a pointed projection inserted into the insulated part.

16. The Universal Serial Bus B-type plug connector as described in claim 15, wherein first crimping section has two side walls and a bottom wall connected therewith, the pointed projection being formed to project from the bottom wall toward the side walls.

17. A shield for use with a plug connector comprising a casing with four contact pieces associated with four corresponding leads of a cable wherein said four contact pieces are disposed within a recess in a front casing portion and the cable extends rearward out of a rear casing portion, said shield comprising a front shield frame portion and a rear shield frame portion commonly defining first fastening means for securing the front shield frame portion to the rear shield frame portion; and said rear shield frame portion including a base with a first and a second wings backward folded commonly defining second fastening means for securely clipping the cable between the two wings, the second fastening means including first locking means on the first wing which cooperates with first locking slot means in the second wing for latchable engagement with each other.

18. A shield as described in claim 17, wherein said first fastening means includes second locking hook means of one of the front shield frame portion and the rear shield frame portion, and cooperatively engagable with second locking slot means of the other of the front shield frame portion and the rear shield frame portion.

* * * * *